US008800503B2

(12) United States Patent
Böhm

(10) Patent No.: US 8,800,503 B2
(45) Date of Patent: Aug. 12, 2014

(54) COOLING CIRCUIT FOR A LIQUID-COOLED INTERNAL COMBUSTION ENGINE

(71) Applicant: Martin Böhm, Burgthann (DE)

(72) Inventor: Martin Böhm, Burgthann (DE)

(73) Assignee: MAN Truck & Bus AG, Munich (DE)

( * ) Notice: Subject to any disclaimer, the term of this patent is extended or adjusted under 35 U.S.C. 154(b) by 0 days.

(21) Appl. No.: 13/625,916

(22) Filed: Sep. 25, 2012

(65) Prior Publication Data

US 2014/0083376 A1 Mar. 27, 2014

(30) Foreign Application Priority Data

Oct. 26, 2011 (DE) ..... 10 2011 116 933

(51) Int. Cl.
*F02D 9/06* (2006.01)

(52) U.S. Cl.
USPC ..... 123/41.31; 123/41.09; 123/41.08; 123/41.02; 123/188.9; 137/625; 137/625.15

(58) Field of Classification Search
CPC ..... F02D 9/06; F02D 2009/0242
USPC ..... 123/41.1, 41.09, 41.02, 41.4, 41.58, 123/188.9, 25 Q; 137/625.15
See application file for complete search history.

(56) References Cited

U.S. PATENT DOCUMENTS

| | | | | |
|---|---|---|---|---|
| 5,950,576 | A * | 9/1999 | Busato et al. | 123/41.08 |
| 6,164,248 | A * | 12/2000 | Lehmann | 123/41.1 |
| 6,668,766 | B1 * | 12/2003 | Liederman et al. | 123/41.44 |
| 7,506,664 | B2 * | 3/2009 | Norris et al. | 137/625.46 |
| 2003/0033993 | A1 * | 2/2003 | Valaszkai et al. | 123/41.31 |
| 2007/0131181 | A1 | 6/2007 | Vogelsang | |

FOREIGN PATENT DOCUMENTS

| | | |
|---|---|---|
| DE | 103 32 907 | 2/2005 |
| DE | 10 2007 055 6 | 5/2009 |
| WO | WO 98/15726 | 4/1998 |
| WO | WO 2008/043425 | 4/2008 |
| WO | WO 2011/107240 | 9/2011 |

* cited by examiner

*Primary Examiner* — Lindsay Low
*Assistant Examiner* — Kevin Lathers
(74) *Attorney, Agent, or Firm* — Cozen O'Connor

(57) ABSTRACT

A cooling circuit for a liquid-cooled internal combustion engine for motor vehicles, includes a main cooling circuit including a feed line leading to a radiator and a return line, and a bypass line, which bypasses the radiator and can be controlled as a function of temperature and secondary cooling circuit for a retarder of a braking device of the motor vehicle, which is connected, likewise by a feed line, a return line and a control valve, to the main cooling circuit. The two cooling circuits (2, 3) can be controlled by a single rotary slide valve (10). Both cooling circuits (2, 3) are interconnected in such a way that the flow rates thereof to the radiator (6) and/or to the retarder (4) can be varied in a predetermined or defined manner, in particular between 0% and 100%.

20 Claims, 5 Drawing Sheets

COOLING CIRCUIT FOR A LIQUID-COOLED INTERNAL COMBUSTION ENGINE

BACKGROUND OF THE INVENTION

1. Field of the Invention

The present invention relates to a cooling circuit for a liquid-cooled internal combustion engine for motor vehicles including a control valve for controlling the flow rates.

2. Description of the Related Art

US published application US2007/0131181A1 describes a cooling circuit for an internal combustion engine, which has a main cooling circuit for the internal combustion engine and a secondary cooling circuit for a retarder as a braking device of the motor vehicle. The main cooling circuit, which has an integrated bypass line for decoupling the radiator when the internal combustion engine is still cold, is controlled by a thermostatic valve. The heat generated in the retarder in the activated state or braking mode, is dissipated via the main cooling circuit. In this arrangement, a changeover valve is integrated into the secondary cooling circuit and, by this valve, the secondary cooling circuit can be decoupled when the retarder is not activated in order to relieve the load on the delivery pump supplying both cooling circuits.

It is an object of the invention to provide a cooling circuit of the type in question which, while involving little outlay on construction, allows improved thermal design and control of the fluid flows in both circuits.

SUMMARY OF THE INVENTION

According to the present invention, the two cooling circuits are controlled by a single rotary slide valve which has a housing with throughflow openings. The two cooling circuits are interconnected at the rotary slide valve in such a way that the flow rates thereof to the radiator and/or to the retarder can be varied in a predetermined or defined manner, preferably between 0% and 100%. The rotary slide valve not only makes it possible selectively to decouple the radiator and/or the secondary circuit of the retarder but also allows any desired intermediate positions for improved thermal control and adaptation to various operating states of the internal combustion engine and of the retarder, and does so in a manner which is simple in terms of construction and of control engineering.

In a particularly advantageous embodiment, the housing of the rotary slide valve has four throughflow openings and can be inserted into the feed line leading from the internal combustion engine to the radiator, wherein the bypass line is connected between the feed line and the return line of the main circuit by a third throughflow opening, and, finally, the return line of the retarder is connected to the fourth throughflow opening, and wherein furthermore the feed line of the retarder is connected to the feed line of the main cooling circuit upstream of the rotary slide valve.

In an embodiment of the rotary slide which is simple in terms of design, three of the throughflow openings can be arranged radially and so as to be distributed in a circumferential direction on the housing of the rotary slide valve, and can be controlled by a rotary slide, e.g. a rotary slide which is crescent-shaped in cross section, and wherein the fourth throughflow opening for the return line of the retarder is aligned axially with respect to the rotary slide and is continuously open. This has the advantage, in particular, that only three throughflow openings have to be controlled by the rotary slide, while, in the case of the continuously open throughflow opening, the flow resistance of the secondary circuit is incorporated into the control system.

For this purpose, it can furthermore be advantageous if a restriction element is provided in the feed line leading from the internal combustion engine to the radiator, upstream of the rotary slide valve but downstream of the branch point of the feed line of the secondary cooling circuit, said restriction element ensuring a minimum throughput of cooling fluid through the retarder. By way of example, the restriction element can be formed by an orifice plate or a reduction in cross section in the region of the rotary slide feed.

In a particularly advantageous embodiment of the invention, a delivery device, in particular a delivery pump, is inserted into the main cooling circuit, and preferably provision is made for the delivery device in the main cooling circuit to be of output-controlled design and/or to be capable temporarily of operation with a greater or lesser delivery rate in accordance with the operating position of the rotary slide valve. In this case, the delivery device can be formed by an electrically controllable delivery pump, for example, or, alternatively, can be formed by a mechanical delivery pump which is coupled to the internal combustion engine and hence to the rotational speed thereof by a coupling device, e.g. by a belt drive as schematically shown at 17 in FIG. 10. In the latter case, the delivery rate can, in turn, be controllable by an adjusting device, it being possible, for example, for a clutch device as schematically shown at 18 in FIG. 10 to be used as an adjusting device, e.g. a magnetic clutch or a viscous coupling, to name just a few examples. As an alternative or in addition, however, the adjusting device can also be formed by an adjustable guide vane arrangement as schematically shown at 19 in FIG. 10. In the case of such a construction, the driving power for the delivery pump can be significantly reduced (while the delivery rate remains constant) when the retarder is decoupled by the rotary slide valve and/or when the main cooling circuit is operated in bypass mode (with no flow through the radiator), thus making it possible to save motive power from the internal combustion engine.

In a preferred embodiment, the rotary slide valve or rotary slide can be adjustable electrically by a stepper motor, wherein the operating temperatures of the cooling circuits, load states of the internal combustion engine and operating states of the service brake of the motor vehicle are detected, and the rotary slide and, if appropriate, the delivery rate of the delivery pump are adjusted in accordance with said data. In a preferred embodiment, the stepper motor can adjust the rotary slide in both directions of rotation and thus control different switching sequences.

To achieve a failsafe setting, it is furthermore possible to provide the rotary slide valve with at least one position sensor, e.g. a rotation angle sensor, and for the operation thereof to be monitored electronically in a feedback control system. If a malfunction is detected, a warning signal can then be generated and/or a safety position of the rotary slide can be adopted (e.g. both cooling circuits are opened, increase in the output of the delivery pump etc.).

In a heating function for the internal combustion engine (e.g. in the case of extremely low outside temperatures and/or for comfortable cold driving performance and/or for a rapid response from an interior heating system connected to the main cooling circuit), the retarder can furthermore be activated and the secondary cooling circuit thereof can be connected temporarily to the bypassed main cooling circuit by the rotary slide valve. This results in a dual effect owing to the heating of the retarder, on the one hand, while, on the other hand, the braking mode thereof leads to higher driving power from the internal combustion engine combined with a higher temporary fuel flow rate and more rapid warming up of the internal combustion engine.

The rotary slide of the rotary slide valve can be spring-loaded into a predetermined position, in which both the main cooling circuit and the secondary cooling circuit are connected to the radiator of the main cooling circuit in terms of flow. This is an advantageous way of ensuring that the cooling of the internal combustion engine and of the retarder is maintained if there is a failure in the electric actuating system of the rotary slide. The preloading can be produced by leg springs acting on the rotary slide and on the housing in a circumferential direction, for example.

Finally, in a design which is compact in terms of construction and advantageous in terms of weight, the rotary slide valve and the delivery pump of the main cooling circuit can be arranged in a common housing.

A method for operating the above described cooling circuit to achieve the abovementioned advantages, is also claimed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An exemplary embodiment of the present invention is explained in greater detail below with reference to the attached schematic drawings, in which.

DETAILED DESCRIPTION OF THE PRESENTLY PREFERRED EMBODIMENTS

Figure 1:
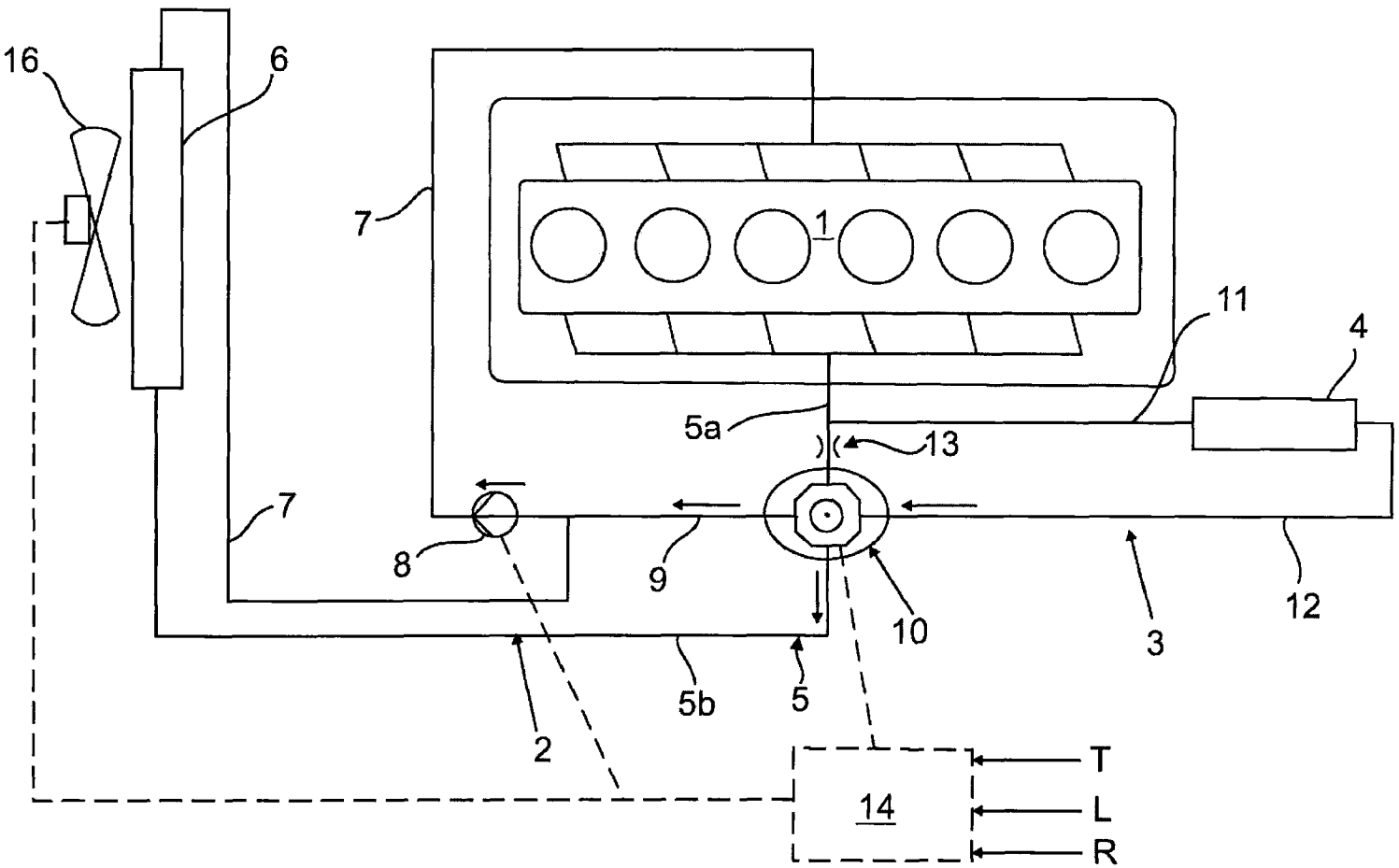
FIG. 1 is a block diagram showing the cooling circuit of the present invention.
Figure 2:
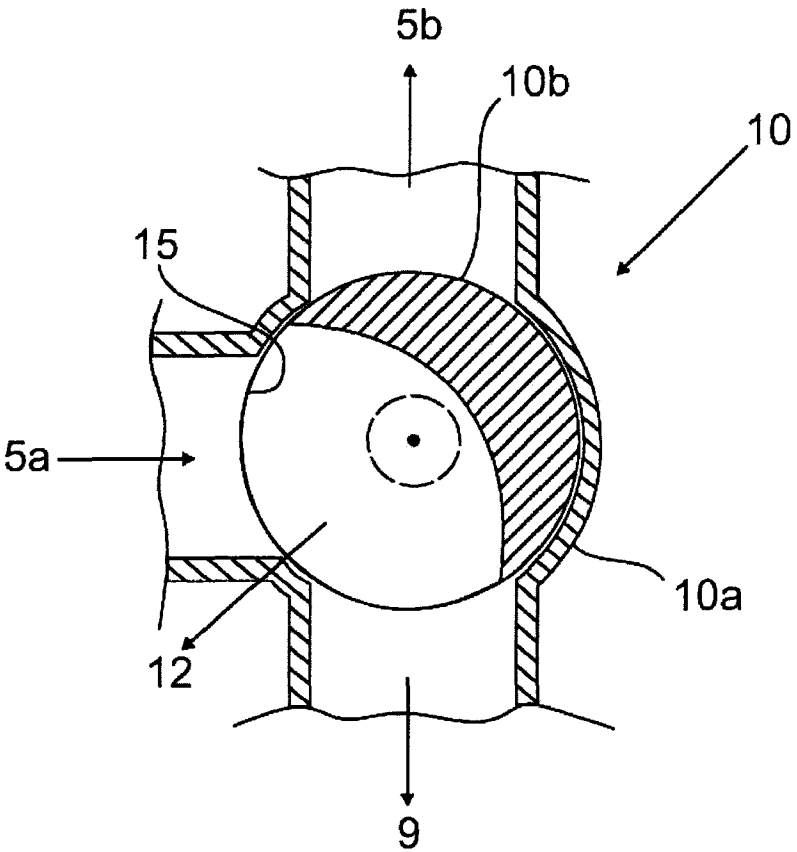
FIG. 2 to FIG. 9 are cross-sectional views of the rotary side valve of the present inventions in eight different operating positions.

FIG. 1, which is a simplified block diagram, shows a cooling circuit for an internal combustion engine in motor vehicles, having a main cooling circuit and a secondary cooling circuit for a retarder as a braking device of the motor vehicle, and having an electrically actuated rotary slide valve for controlling both cooling circuits, and FIGS. 2 to 9 show a cross section through the housing of the rotary slide valve with eight possible positions of the rotary slide for controlling the main and secondary cooling circuits.

In FIG. 1, the cooling circuit of a liquid-cooled internal combustion engine 1 for motor vehicles is shown in a highly schematic form, having a main cooling circuit 2 and a secondary cooling circuit 3 for a retarder 4 (shown in a purely schematic way) of a braking device (continuous service brake), not shown specifically, of the motor vehicle.

The main cooling circuit 2 consists essentially of a feed line 5 leading from the internal combustion engine 1 to an air/water heat exchanger or radiator 6 and of a return line 7 from the radiator 6 to the internal combustion engine 1. A delivery pump 8 with a variably controllable delivery rate is arranged in the return line 7.

Figure 10:
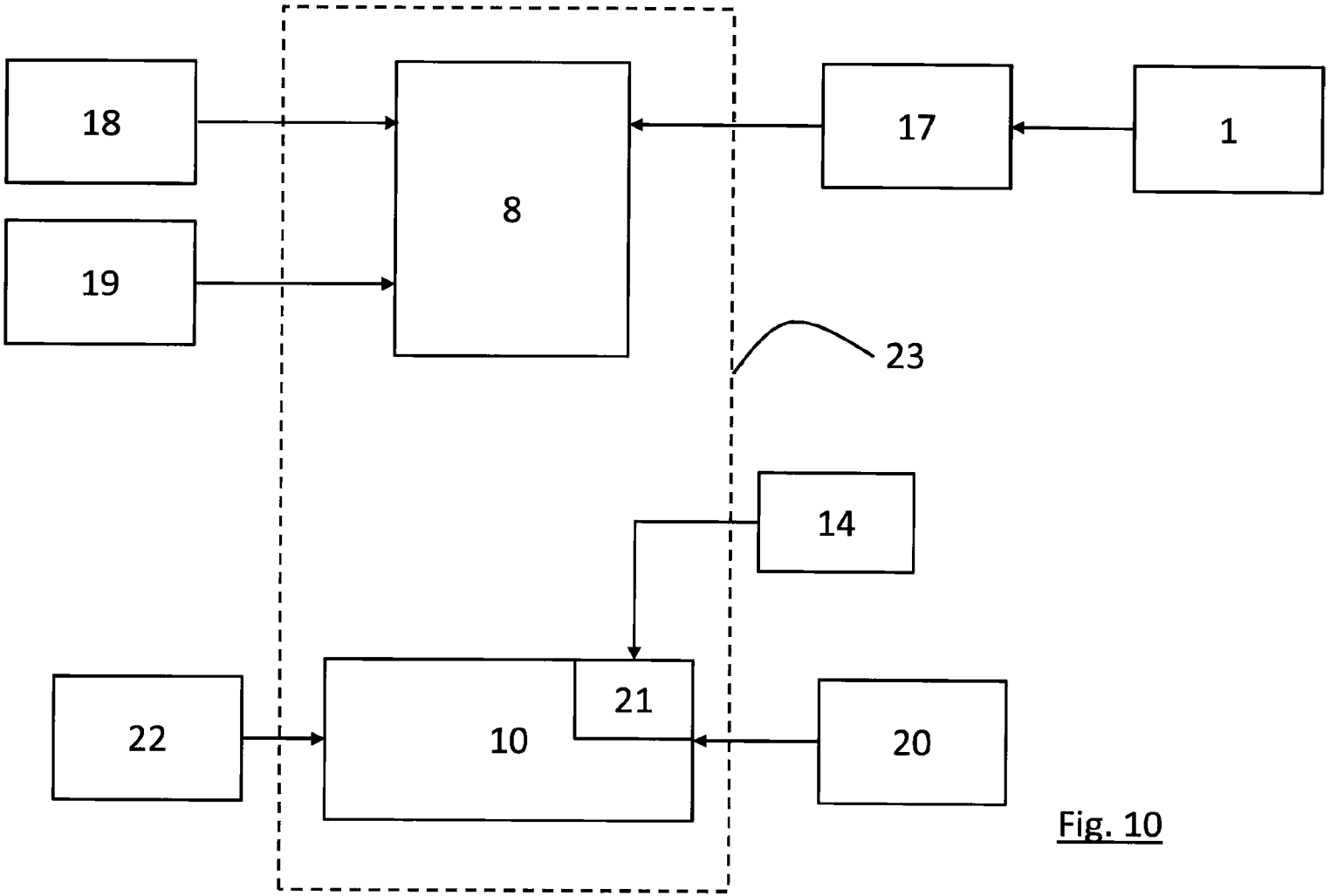
FIG. 10 is a block diagram schematically showing the elements of the cooling circuit of the present invention.

A bypass line 9, which can be controlled by a rotary slide valve 10 actuated by an electric stepper motor 20 (FIG. 10), is inserted between the feed line 5 and the return line 7, downstream of the delivery pump 8.

The main cooling circuit 2 is shown only to the extent required for an understanding of the present invention. Additional cooling circuit connections, e.g. an interior heating system of the motor vehicle etc., are not shown.

The secondary cooling circuit 3 for cooling the retarder 4 (e.g. by a heat exchanger or by direct impingement) likewise has a feed line 11 and a return line 12.

The feed line 11 is connected to a section 5*a* of the feed line 5 of the main cooling circuit 2 upstream of the rotary slide valve 10, and a restriction device 13 (e.g. a defined constriction) can be provided in the feed line 5*a* between the connection point of the two feed lines 5*a*, 11 and the rotary slide valve 10.

The delivery pump 8 and the stepper motor 20 of the rotary slide valve 10 are controlled by an electronic control unit 14 (indicated in dashed lines), which brings about the variable output of the delivery pump 8 by varying the rotational speed or volume flow, for example, and effects the setting of the rotary slide valve 10 to the operating positions described below. If appropriate, the control unit 14 can also control an electric radiator fan 16 on the radiator 6.

For this purpose, the data from temperature sensors T (not shown), e.g. in the feed lines 5, 12, on load states L of the internal combustion engine (e.g. traction or overrun mode), on the operating state R of the retarder 4 etc. are detected and processed for control purposes in the control unit 14.

FIGS. 2 to 9 show a cross section through the housing 10*a* of the rotary slide valve 10, in which the crescent-shaped rotary slide 10*b* is rotatably mounted. The rotary slide 10*b*, which is sealed off from the outside, can be adjusted by the stepper motor 20 (FIG. 10) to the positions described below, varying from zero degrees (FIG. 2) to 315 degrees (FIG. 9), for example.

Arranged on the housing 10*a* are three connection stubs, which, as can be seen, are offset over the circumference, branch off radially and adjoin throughflow openings which are blocked or exposed to a greater or lesser extent by the rotary slide 10*b*. Section 5*a* of the feed line 5, the onward-leading feed line section 5*b* and the bypass line 9 (each indicated by arrows) are connected to the connection stubs.

Another connection stub 15 of the return line 12 is aligned coaxially with the axis of rotation of the rotary slide 10*b*, and the throughflow opening thereof is continuously open or, depending on the position of the rotary slide, connected to one or two of the other three throughflow openings.

In the zero degrees starting position of the rotary slide 10*b* (FIG. 2), the throughflow openings of the feed section 5*a* of the feed line 5 and of the bypass line 9 are fully open.

The throughflow opening of the onward-leading feed line section 5*b* is closed. This position corresponds to a cold start of the internal combustion engine 1.

In this operating position, cooling fluid is recirculated from the internal combustion engine 1, via the bypass line 9, the delivery pump 8 and the remaining section of the return line 7, back to the internal combustion engine 1. The radiator 6 is decoupled, and therefore there is no flow through it.

The secondary cooling circuit 3 containing the retarder 4 is likewise decoupled, owing to the higher flow resistance thereof, although a low minimum flow rate can be set by the restriction 13, if appropriate.

The division of the flow of cooling fluid is as follows, for example:

Radiator 6—0%;

Bypass line 9—100%;

Retarder 4—0%;

Output of the delivery pump 8 reduced or even briefly switched off.

Figure 3:
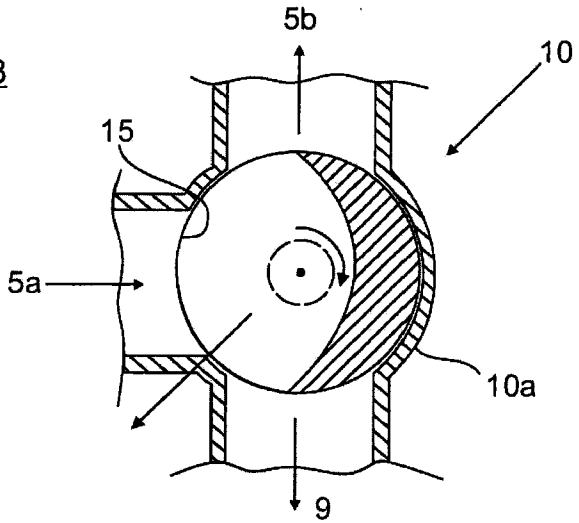

FIG. 3 shows the operating position of the rotary slide 10*b* as the internal combustion engine 1 increasingly warms up, in which the throughflow opening of feed line section 5*a* is fully open and the throughflow openings of feed line section 5*b* and of the bypass line 9 are partially open, and the radiator 6 is thus connected into the circulation of cooling fluid, accounting for about 50% thereof. Due to the higher flow resistance of the secondary cooling circuit 3, the retarder 4 remains decoupled as before, without alteration.

Figure 4:
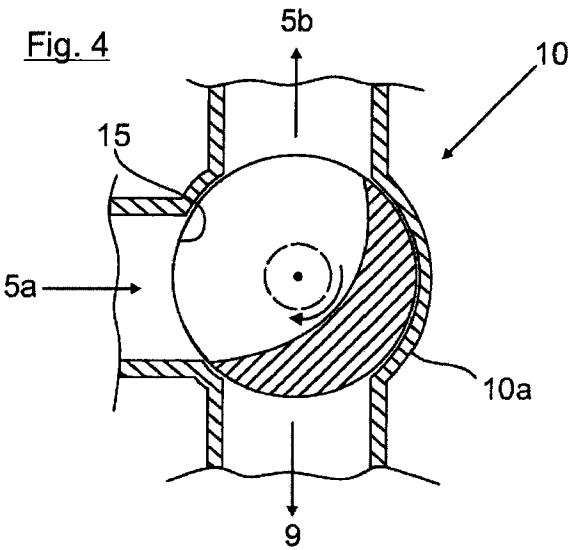

As soon as the internal combustion engine 1 has reached the operating temperature thereof, the rotary slide 10*b* is adjusted by the stepper motor 20 to the operating position illustrated in FIG. 4, in which the bypass line 9 is closed and feed line section 5*b* leading to the radiator 6 and feed line section 5*a* of the feed line 5 are fully open. For the reasons mentioned above, the retarder 4 remains decoupled. The output of the delivery pump 8 may already be at an increased level.

Figure 5:
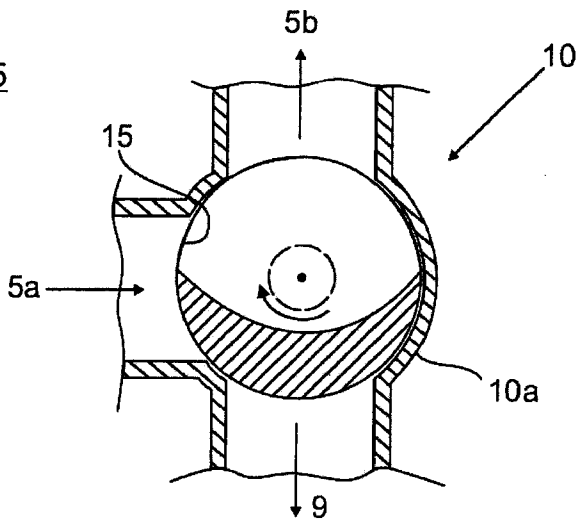

In FIG. 5, the rotary slide 10*b* has been adjusted to a position in which the throughflow opening leading to feed line section 5*b* is still fully open but the throughflow opening of feed line section 5*a* has been partially closed. The output of the delivery pump 8 may have increased further.

This has the effect that the delivery pump 8 draws in cooling fluid both via feed line section 5*b* of the main cooling circuit 2 and via the feed line 11 of the secondary cooling circuit 3 and that both circuits 1 and 2 are coupled. This may be the case, for example, when the retarder 4 is in braking mode and the internal combustion engine 1 is relatively hot.

Figure 6:
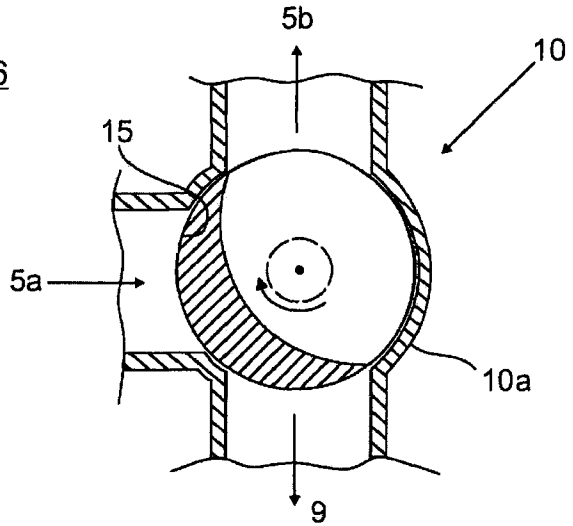

In the operating position of the rotary slide 10*b* shown in FIG. 6, the throughflow opening of the bypass line 9 remains closed, and the connection of feed line section 5*a* of the feed line 5 is also closed. The delivery pump 8 is switched to full capacity.

Consequently, both cooling circuits 2 and 3 are fully included in the circulation of cooling fluid and are switched to full cooling capacity. The flow of cooling fluid flows via feed line section 5*a* of feed line 5, feed line 11, the retarder 4, the return line 12, feed line section 5*b* of the main cooling circuit, the radiator 6 etc.

Figure 7:
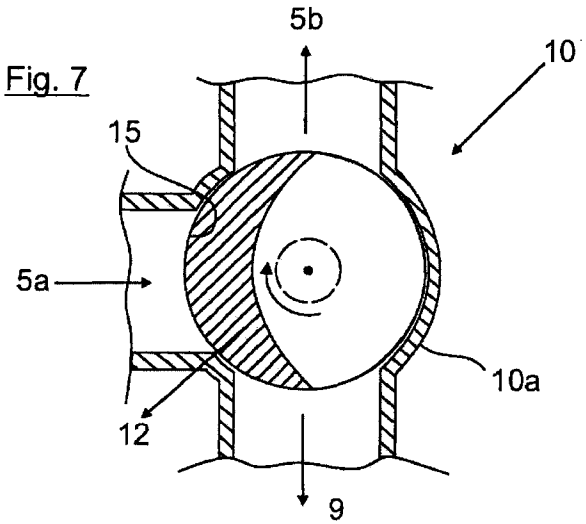

If the temperature T of the internal combustion engine 1 decreases, e.g. during a prolonged overrun phase of the motor vehicle with the internal combustion engine 1 switched off, the rotary slide 10*b* can be adjusted to an operating position in accordance with FIG. 7, in which feed line section 5*a* remains closed but the throughflow opening for the bypass line 9 is partially open. The result is that, while there is still full flow through the retarder 4, the flow through the internal combustion engine 1 is reduced.

Figure 8:
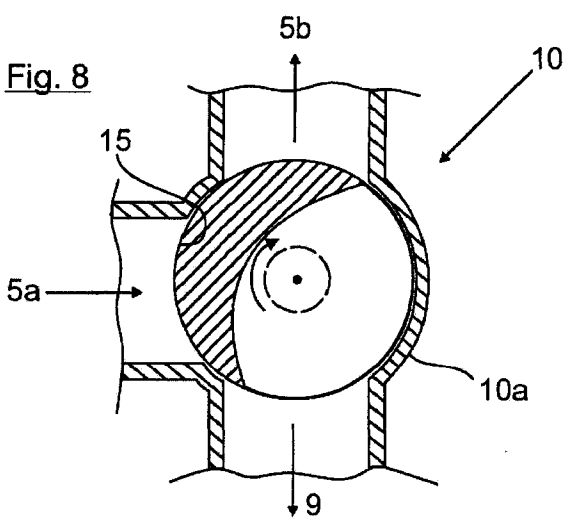

In the case of a prolonged overrun phase, with the internal combustion engine 1 possibly cooling down further, this state can be intensified, in accordance with FIG. 8, in such a way that, with the throughflow openings of feed line section 5*a* and of feed line section 5*b* closed and with the throughflow opening of the bypass line 9 open, there continues to be full flow through the retarder 4, the throughput of cooling fluid taking place via the feed line 11 of the secondary cooling circuit 3, the retarder 4, the return line 12 thereof, the bypass line 9, the delivery pump 8 and the upstream return line 7. The retarder 4 thus additionally brings about heating or temperature stabilization of the internal combustion engine 1 while the radiator 6 is decoupled.

Figure 9:
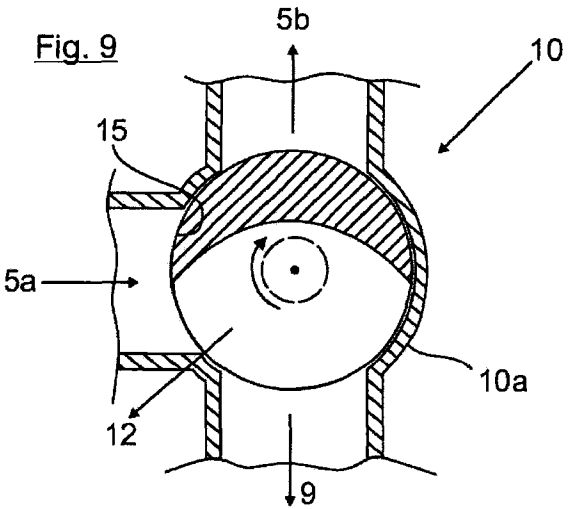

Finally, in the operating position of the rotary slide 10*b* shown in FIG. 9, the throughflow opening of the bypass line 9 remains fully open and that of feed line section 5*b* remains fully closed, while the throughflow opening of feed line section 5*a* of the feed line 5*b* is partially open. As a result, the cooling capacity for the retarder 4 is reduced and, if appropriate, the output of the delivery pump 8 can also be throttled back.

The rotary slide valve 10 is not restricted to the embodiment illustrated.

Thus, instead of a stepper motor 20 that can be adjusted in both directions of rotation, it is also possible to provide some other electric, mechanical, pneumatic, hydraulic or magnetic actuating system.

The rotary slide 10*b* can be preloaded into an operating position, e.g. that shown in FIG. 6, by resilient means (e.g. leg springs 22 in FIG. 10), which move said rotary slide automatically into this position if the electric actuating system fails and hold it there. This ensures that both cooling circuits 2, 3 are in service and that impermissible overheating cannot occur.

Moreover, the rotary slide valve 10 can be provided with at least one position sensor, e.g. a rotation angle sensor 21, which is connected to the control unit 14 in order in this way to electronically assure the operation of the rotary slide 10*b* in a feedback control system.

In addition to the functions described of the rotary slide valve 10, the retarder 4 can be activated in a heating function for the internal combustion engine 1 and the secondary cooling circuit 3 of said retarder can be connected temporarily to the bypassed main cooling circuit 2 by the rotary slide valve 10 (operating position of the rotary slide 10*b* as shown in FIG. 8). The essential difference here is that the internal combustion engine 1 is under power and is to be operated with a higher load requirement in order to overcome the input braking power. This represents a particularly effective heating phase for the internal combustion engine 1.

If appropriate, the delivery pump 8 and the rotary slide valve 10 can be arranged in a common housing 23 with an integrated bypass line 9, thereby reducing the outlay in terms of construction and creating a particularly compact design which is advantageous in terms of assembly.

In addition to the illustrated operating positions of the rotary slide 10*b* in FIGS. 2 to 9, it is also possible for additional intermediate positions of the rotary slide 10*b* to be selected in an infinitely variable manner by the stepper motor 20, and this can be the case in both directions of rotation with different switching sequences as compared with the above description.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A cooling circuit for a liquid-cooled internal combustion engine for a motor vehicle comprising:

a main cooling circuit (2) including a radiator (6);

a feed line (5) leading to said radiator (6); and a return line (7) leading away from said radiator (6);

a bypass line (9) bypassing said radiator (6) and constructed so as to be controllable as a function of predetermined parameters;

a retarder (4) of a braking device;

a secondary cooling circuit (3) for said retarder (4), said secondary cooling circuit (3) having a feed line (11) and a return line (12); said main cooling circuit (2) having a flow rate to said radiator (6) and said secondary cooling circuit (3) having a flow rate to said retarder (4);

a single rotary slide valve (10) arranged for controlling said main cooling circuit (2) and said secondary cooling circuit (3); said main cooling circuit (2) and said secondary cooling circuit (3) being interconnected for varying at least one of the flow rate to said radiator (6) and the flow rate to said retarder (4) in a defined manner;

wherein said rotary slide valve (10) comprises a housing (10*a*) having four throughflow openings therein and being inserted into said feed line (5) leading from the internal combustion engine to said radiator (6); said bypass line (9) being connected to a third throughflow opening of said rotary slide valve between said feed line (5) and said return line (12); said return line (12) of said retarder (4) connected to a fourth throughflow opening (15); and wherein said feed line (11) of said retarder (4) is connected to said feed line (5*a*) of said main cooling circuit (3) upstream of said rotary slide valve (10); and wherein three of said four throughflow openings are arranged radially on said housing (10*a*) of said rotary slide valve (10); said rotary slide valve further comprising a crescent-shaped rotary slide (10*b*); said fourth throughflow opening (15) for said return line (12) of said retarder (4) being aligned axially with respect to said rotary slide (10*b*) and being permanently open; and wherein said housing, said rotary slide and said three radial throughflow openings are constructed so as to permit a least the simultaneous partial opening of all three radially arranged throughflow openings.

2. The cooling circuit according to claim 1, wherein one of the flow rate of said radiator (6) and the flow rate of said retarder (4) is varied between 0% and 100%.

3. The cooling circuit according to claim 1, wherein said three throughflow openings are arranged in one of a common plane and so as to be distributed in a circumferential direction.

4. The cooling circuit according to claim 1, wherein said rotary slide valve (10) includes a rotary slide (106) having a crescent shaped cross section.

5. The cooling circuit according to claim 1, additionally comprising a restriction element (13) disposed in said feed line (5) leading from the internal combustion engine to said radiator (6) upstream of said rotary slide valve (10) but downstream of a branch point of said feed line (11) of said secondary cooling circuit (3); said restriction element (13) designed to ensure a minimum throughput of cooling liquid through said retarder (4).

6. The cooling circuit according to claim 1, additionally comprising a delivery device (8) having a delivery rate and disposed into said main cooling circuit 2.

7. The cooling circuit according to claim 6, wherein said delivery device is a delivery pump.

8. The cooling circuit according to claim 7, wherein said delivery pump is one of output-controlled and capable of temporarily being operated with a greater or lesser delivery rate in accordance with the operating position of said rotary slide valve 10.

9. The cooling circuit according to claim 6, wherein said delivery device (8) is one of an electrically controllable delivery pump and a mechanical delivery pump, said mechanical delivery pump including a coupling device for coupling said delivery pump to the internal combustion engine (1) and an adjusting device for controlling said delivery rate of said delivery device.

10. The cooling circuit according to claim 9, wherein said coupling device is a belt drive (17).

11. The cooling circuit according to claim 9, wherein said adjusting device is a clutch device (18) or an adjustable guide vane arrangement (19).

12. The cooling circuit according to claim 6, wherein said rotary slide valve (10) is constructed so as to be capable of one of decoupling said retarder (4) and bypassing said main cooling circuit (2) thereby reducing the delivery rate of said delivery device in relation to a constant delivery rate.

13. The cooling circuit according to claim 6, wherein said rotary slide valve (10) and said delivery device (8) of said main cooling circuit (2) are arranged in a common housing.

14. The cooling circuit according to claim 1, additionally comprising an auxiliary power device for adjusting said rotary slide valve (10), wherein parameters of one of the operating temperatures (T) of said cooling circuits (2, 3), the load states (L) of the internal combustion engine and the operating states (R) of said retarder (4) are detected and at least one of said rotary slide valve (10) and said delivery rate of said delivery pump is adjusted in accordance with said parameters.

15. The cooling circuit according to claim 14, wherein said auxiliary power device is one of an electrical, pneumatical, hydraulic and magnetical power device.

16. The cooling circuit according to claim 15, wherein said auxiliary power device is a stepper motor (20).

17. The cooling circuit according to claim 1, additionally comprising a control unit (14) including a feedback system; and wherein said rotary slide valve additionally comprises at least one position sensor (21) for monitoring the operation of said rotary slide valve in said feedback control system of said control unit.

18. The cooling circuit according to claim 1, wherein said rotary slide valve (10) is constructed so as to activate said retarder (4) in a heating function for the internal combustion engine and the secondary cooling circuit (3) is connected temporarily to said bypassed main cooling circuit (3).

19. The cooling circuit according to claim 1, wherein said rotary slide (10*b*) of said rotary slide valve (10) is spring-loaded into a predetermined operating position so that both said main cooling circuit (2) and said secondary cooling circuit (3) are connected to said radiator (6) of said main cooling circuit (2) in terms of flow.

20. A method of operating a cooling circuit according to claim 1.

* * * * *